United States Patent [19]

Golowash

[11] Patent Number: 4,761,524

[45] Date of Patent: Aug. 2, 1988

[54] SWITCH OPERATING MECHANISM

[75] Inventor: Victor Golowash, Birmingham, Ala.

[73] Assignee: Electrical Equipment, Inc., Birmingham, Ala.

[21] Appl. No.: 54,228

[22] Filed: May 26, 1987

[51] Int. Cl.[4] ..... H01H 21/42

[52] U.S. Cl. ..... 200/153 SC; 74/97

[58] Field of Search ..... 200/153 SC; 74/97

[56] References Cited

U.S. PATENT DOCUMENTS 3,211,870 10/1965 Lusk et al. ..... 200/153 SC 3,919,512 11/1975 Ray et al. ..... 200/153 SC

*Primary Examiner*—Renee S. Luebke

*Attorney, Agent, or Firm*—Jennings, Carter, Thompson & Veal

[57] ABSTRACT

A switch operating mechanism for a multi-position switch utilizes a stored energy member to store input energy applied to the mechanism and then release the stored energy to move an associated switch responsive to a predetermined input to the mechanism. A gradual application of force results in a rapid discharge of energy to move the switch.

20 Claims, 3 Drawing Sheets

SWITCH OPERATING MECHANISM

FIELD OF THE INVENTION

The present invention relates to electromechanical switch gear and more particularly to a mechanism for moving a switch or the like selectively to one of a number of predetermined positions. More particularly, the present invention relates to a mechanism which moves a switch rapidly between selected positions responsive to a predetermined movement imparted to the mechanism. In even greater particularity, the present invention may be described as a mechanism for moving a switch between selected positions using energy stored within the mechanism by movement of a portion of the mechanism relative to the switch.

SUMMARY OF THE INVENTION

It is an object of this invention to provide a mechanism which will convert the kinetic energy required to open an electrical switch into potential energy which can be released to rapidly open the contacts of such a switch.

Another object of the invention is to provide such a mechanism which is capable of moving the switch between selected pairs of a plurality of positions.

Still another object of the invention is to provide a mechanism with the above features which locks the switch into a selected position.

Yet another object of the invention is to provide a mechanism with the above features which is free of oscillation in an open position.

These and other features and advantages of my invention are accomplished through a novel connection between the input force applied to my apparatus and the output force supplied by my apparatus. Essentially this means that I utilize stored energy components to store the mechanical energy required to move a switch until such time as that energy can be applied to achieve a rapid movement of the switch contacts. To accomplish this, I provide an output mechanism which is locked in one of a number of preselected positions while input force is applied to the input mechanism of the apparatus. As the input force is applied, a portion of the energy provided is utilized to charge a stored energy system which connects the input and output mechanism and the remainder of the energy is expended in moving the input mechanism. When the input mechanism is moved to a preselected point, it interacts with the output mechanism to release the output mechanism from its latched condition whereupon the stored energy device discharges through the output mechanism to open or close the switch. On the input side, the resistance of the energy storage device, which may be power springs, inherently causes the energy to be stored therein at a slower rate. On the output side, however, once the inertia of the switchgear is overcome, a very rapid energy transfer is effected, then the associated switchgear is rapidly moved to the selected position.

BRIEF DESCRIPTION OF THE DRAWINGS

Apparatus embodying features of my invention are depicted in the accompanying drawings which form a portion of this invention and wherein.

DESCRIPTION OF A PREFERRED EMBODIMENT

Figure 1:
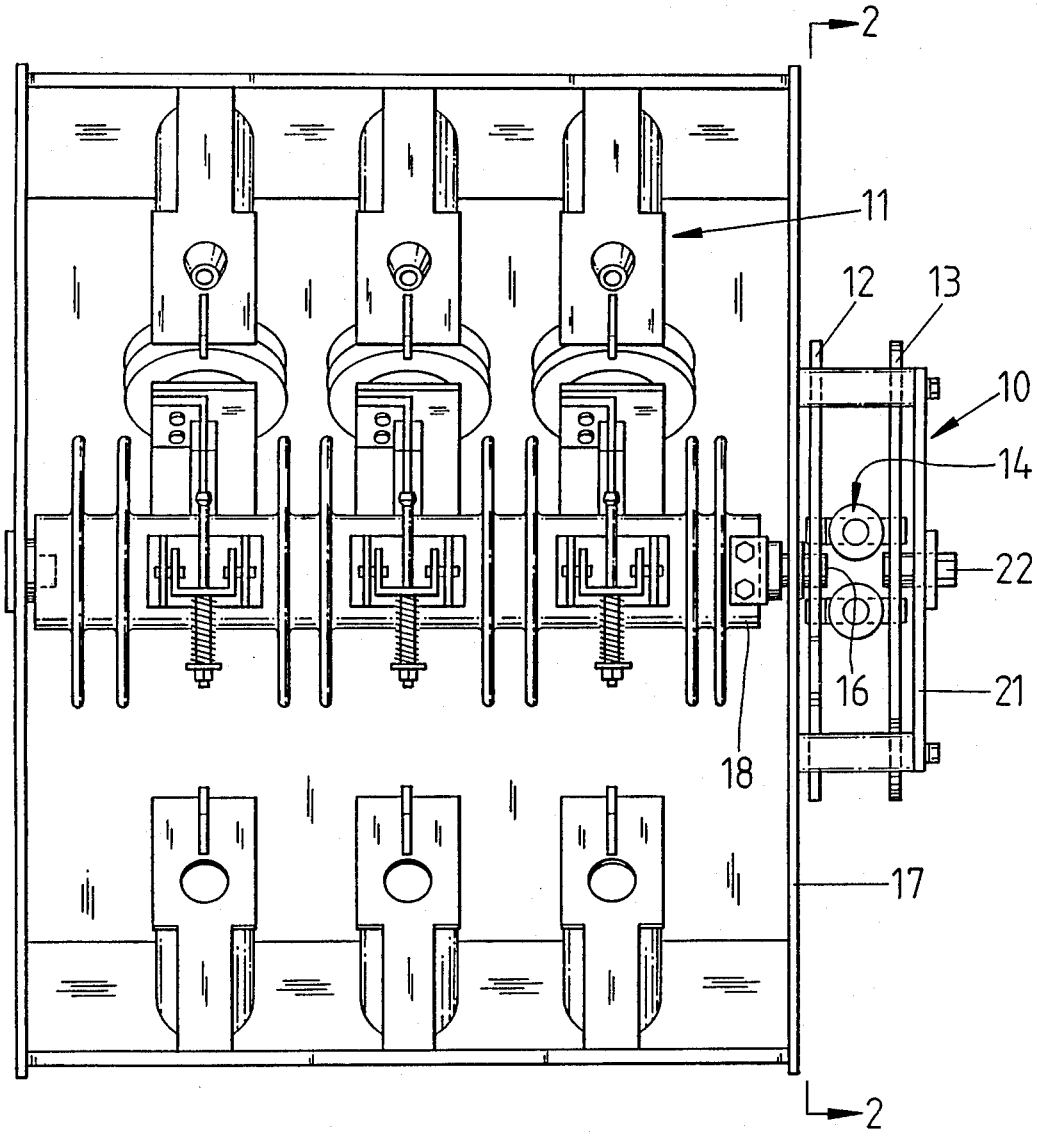
FIG. 1 is a elevation showing my invention in conjunction with an associated switchgear.

With reference to FIG. 1, it may be seen that the present invention shown generally at 10 is an operating mechanism for a multi-position switch 11 such as may be used in high voltage switchgear. The artisan will appreciate the desirability of moving such switchgear between selected positions in a rapid and crisp manner. To effect such action, I provide my operating mechanism 10. The mechanism 10 has as its principal components an operating disc 12, a loading member 13, and a stored energy device 14. Briefly, the stored energy device receives energy during the translation of the loading member 13, and transfers it to the operating disc 12 to move the switchgear 11.

The operating disc 12 is mounted for rotation with a shaft 16 rotatably extending through a sidewall 17 of the switchgear 11 and connected to a blade carrying member 18. The loading member 13, which may also be a disc, is mounted for rotation on an input shaft 22, which extends through a coverplate 21 which is secured to sidewall 17. Shaft 16 and input shaft 22 lie along a common axis. The input shaft 22 terminates in a fitting such that it may be grasped and rotated by an appropriate device such as a lever or motor. The stored energy device 14 serves as the only connecting member between loading member 13 and operating disc 12, thus the loading member would be free to rotate but for this connection.

Figure 3:
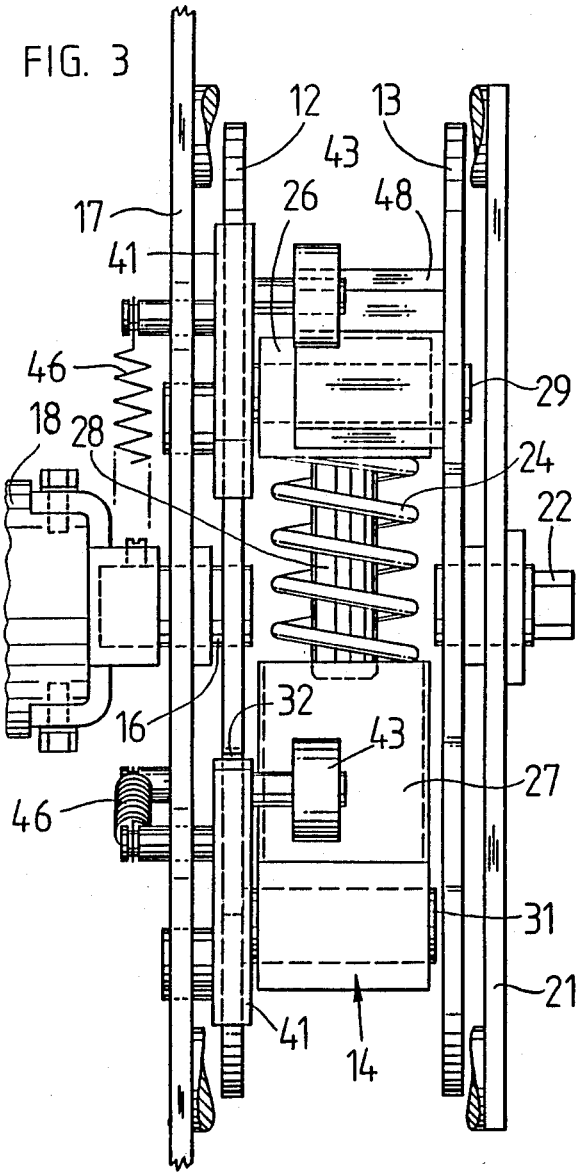
FIG. 3 is a plan view of the apparatus as shown in FIG. 2.
Figure 4:
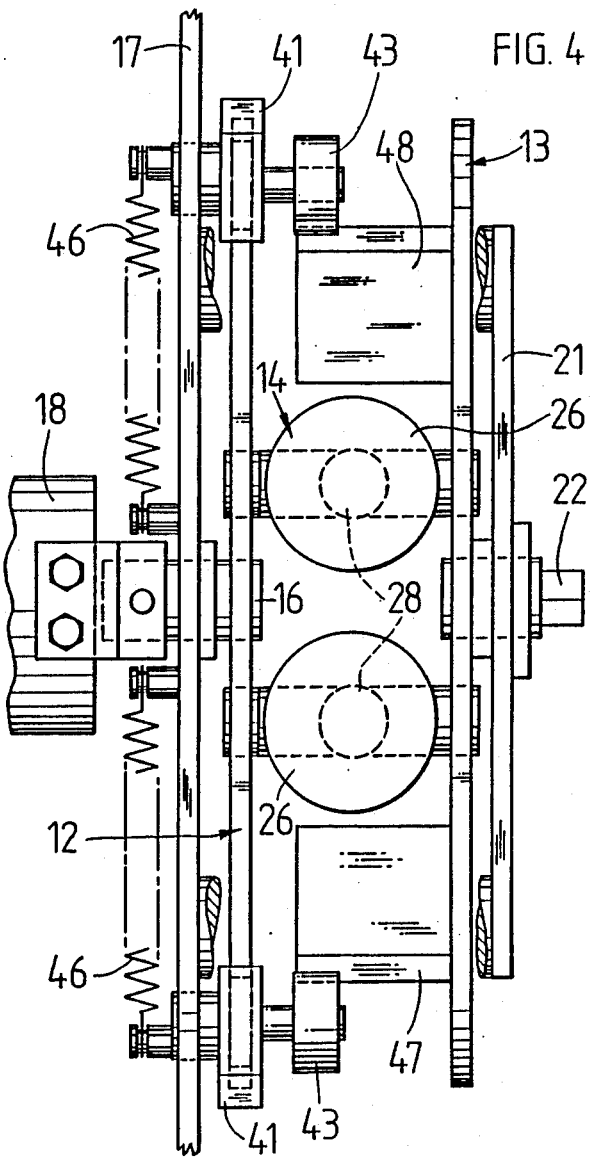
FIG. 4 is a side elevation of the apparatus as shown in FIG. 2.

In the embodiment depicted most clearly in FIGS. 3 and 4, the stored energy device is a pair of power springs 23 and 24 which are confined by sets of guide tubes 26 and 27 and are constrained to move axially by spring rods 28. Guides 26 are pivotally mounted on pivot pins 29 affixed to loading member 13 and guide tubes 27 are pivotally mounted to pivot pins 31 affixed to operating disc 12.

Figure 2:
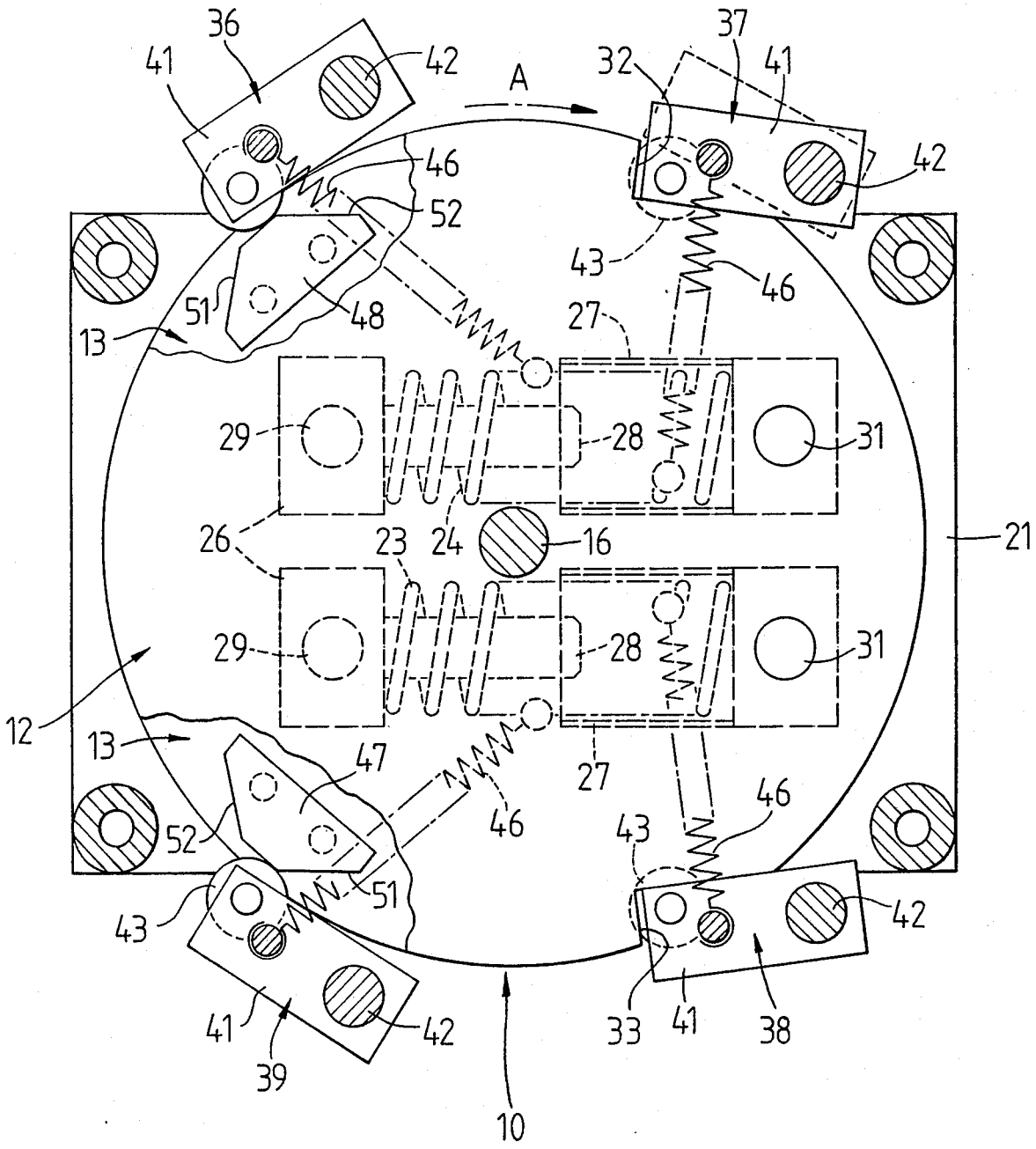
FIG. 2 is a section view taken along line 2—2 of FIG. 1.

As may be seen from FIGS. 2 and 3, the operating disc 12 has a pair of recessed shoulders 32 and 33 formed on the periphery thereof having an angular separation of 100°. These shoulders 32 and 33 are engagable by a plurality of latch members 36–39 which are mounted to the sidewall 17. Each latch member includes a latch bar 41 pivotally mounted on a latch pin 42. Each latch bar 41 carries a cam roller 43 at one end thereof and is cooperatively shaped to engage recessed shoulder 32 or 33. Each latch bar 41 is biased toward engagement with the periphery of the operating disc by a latch spring 46 connected between the latch bar 41 and the sidewall 17. Each cam roller 43 is spaced from the operating disc 12 toward the load member 13 which carries a pair of cooperatively positioned camming wedges 47 and 48 having camming surfaces 51 and 52 thereon.

Figure 5:
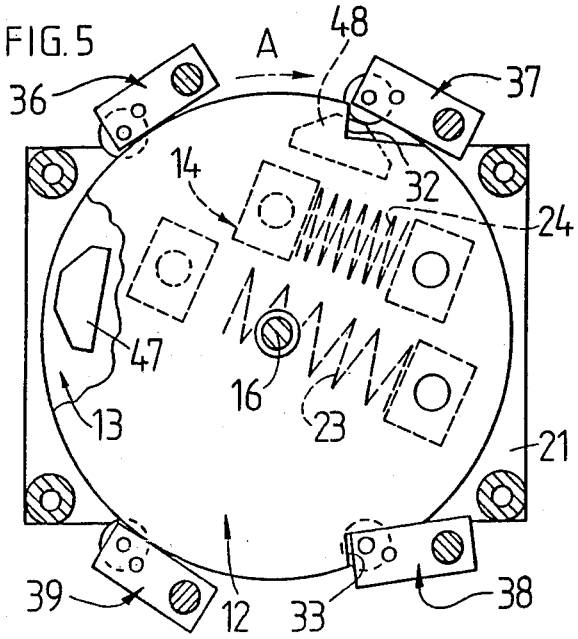
FIG. 5 is a schematic depiction of my operating apparatus in a centered position.
Figure 6:
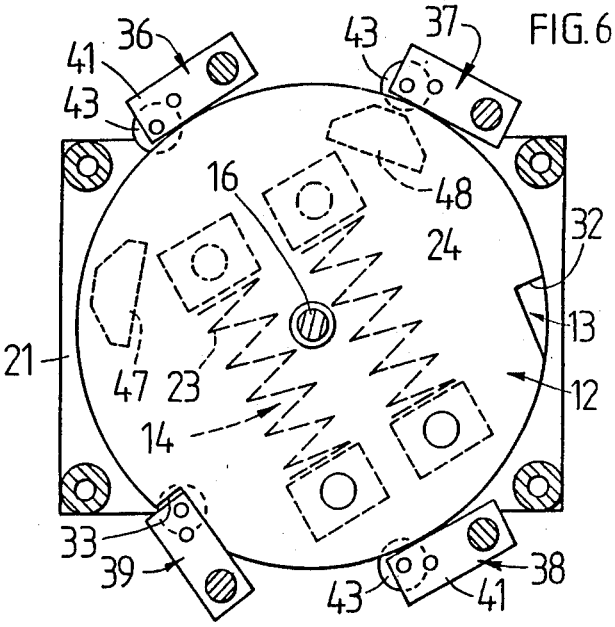
FIG. 6 is a schematic depiction of my operating apparatus in an offset position.

In operation, the mechanism 10 will be at rest in one of three switch positions. For example, in FIG. 2, the operating disc 12 is in the position corresponding to an open switch condition as shown in FIG. 1. To close the switch, the load member is rotated by applying a force to the input shaft 22 in either a clockwise or counterclockwise direction. In FIG. 2, arrow A indicates the direction of motion of the loading member 13 as force is applied. As the load member 13 rotates, operating disc 12 is held immobile by the engagement of latch members 37 and 38 with shoulders 32 and 33 respectively, thus energy is transferred to the springs, thereby elongating spring 23 and compressing spring 24. Continued rotation of the load member 12 brings camming wedge 48 into contact with the cam roller 43 of latch member 37 which causes the latch bar 41 to pivot out of engagement with shoulder 32, releasing operating disc 12, which receives the stored energy of springs 23 and 24 and rotates in the direction of arrow A thereby moving the switchgear to one of the closed positions. In as much as the operating disc 12 rotates equally with the load member, shoulder 33 is brought into engagement with latch member 39 which locks the mechanism in the new position. In the present embodiment, the locked positions are separated by 60°, thus it will be appreciated that with the mechanism 10 in the position just described and as shown in FIG. 6, camming wedge 48 will be displaced 60° clockwise from the position shown in FIG. 2. Thus, to return the mechanism 10 to the position shown in FIGS. 2 and 5, the load member is caused to rotate counterclockwise, thereby compressing spring 23 and elongating spring 24 since the operating disc is held stationary by latch member 39. Then camming wedge 47 engages latch member 39, the operating disc 12 is released and rotates counter-clockwise until latch member 38 engages shoulder 33. Simultaneously, latch member 37 engages shoulder 32 to prevent oscillation or rebound. The mechanism operates in the same manner to move shoulder 33 into engagement with latch member 38.

From the above, it may be seen that, depending on the strength of the stored energy members 14, substantial energy may be stored by rotation of the load member 13 while the operating disc 12 is held stationary. This energy is then rapidly transferred to the operating disc and associated switchgear when the camming wedges cause disengagement of the latch member from the operating disc.

The illustrated embodiment is shown as a three position operating mechanism. It will be appreciated that additional positions may be provided for using additional latch members, however, the instant embodiment is exceedingly useful as the operating mechanism for a three position switch as shown in FIG. 1 and as more fully described in my co-pending application Ser. No. 054,284, filed concurrently herewith.

While I have shown my invention in one form, it will be obvious to those skilled in the art that it is not so limited but is susceptible of various changes and modifications without departing from the spirit thereof.

What I claim is:

1. An operating apparatus for use with a multi-position switch comprising:

(a) a planar member mounted on a first shaft for rotation about an axis therethrough;

(b) a disc-like member connected to said multi-position switch and mounted parallel to said planar member for rotation on a second shaft extending along said axis;

(c) means for arresting rotational motion of said disc-like member at a preselected arc of rotation;

(d) means carried by said planar member for disengaging said arresting means responsive to a predetermined rotation of said planar member relative to said disc-like member; and (e) biasing means for elastically connecting said planar member and said disc-like member.

2. Apparatus as defined in claim 1 wherein said means for arresting comprises:

(a) a plurality of stops formed on the periphery of said disc-like member; and (b) a plurality of latch members pivotally mounted co-planar with said disc-like member and biased toward engagement with said stops formed on the periphery of said disc-like member.

3. Apparatus as defined in claim 2 wherein said means for disengaging comprises a set of spaced apart cam members which urge an engaged latch member to pivot out of engagement with an engaged stop.

4. Apparatus as defined in claim 3 wherein said biasing means comprises a pair of parallel spring members mounted on opposite sides of said axis with each spring member having one end thereof connected to said planar member and another end thereof connected to said disc-like member.

5. Apparatus as defined in claim 1 wherein said biasing means comprises a pair of parallel spring members mounted with each having one end connected to said planar member and another end connected to said disc-like member such that one spring is compressed and the other is elongated by relative motion of said planar member and said disc-like member about said axis.

6. Apparatus as defined in claim 5 wherein said arresting means and said disengaging means cooperate to limit the movement of said disc-like member to incremental rotation responsive to the rotation of said planar member through a predetermined arc.

7. Apparatus as defined in claim 5 wherein each spring member comprises a power spring of a predetermined length, a spring rod insertable within said power spring and guide tubes confining the ends of said power springs and pivotally mounted to said planar member and said disc-like member.

8. Apparatus as defined in claim 7 wherein said means for arresting comprises a plurality of outwardly opening recesses formed on the periphery of said disc-like member and latch means biased toward said disc-like member for engagement within said recesses at a predetermined angular position of said disc-like member.

9. Apparatus as defined in claim 8 wherein said disengaging means comprises spaced apart cam members carried by said planar member for engagement with said latch means to urge said latch means out of engagement with said recesses.

10. Apparatus as defined in claim 9 wherein said latch means each comprise a latch member mounted radially outwardly from said disc-like member for pivotal motion in the same plane as said disc-like member having a first end adapted for engagement within said recess and engagable by said cam members.

11. An apparatus for operation and control of a multi-position switch comprising:

(a) a planar member mounted on a first shaft for rotation about an axis therethrough;

(b) a disc-like member connected to said multi-position switch and mounted parallel to said planar member on a second shaft extending along said axis;

(c) biasing means for elastically connecting said planar member to said disc-like member; and (d) means for limiting the movement of said disc-like member to incremental rotation responsive to the rotation of said planar member through a predetermined arc.

12. Apparatus as defined in claim 11 wherein said biasing means comprises a pair of parallel spring members mounted with each having one end connected to said planar member and another end connected to said disc-like member such that one spring is compressed and the other is elongated by relative motion of said planar member and said disc-like member about said axis.

13. Apparatus as defined in claim 12 wherein each spring member comprises a power spring of a predetermined length, a spring rod inserted within said power spring and guide tubes confining the ends of said power springs and pivotally mounted to said planar member and said disc-like member.

14. Apparatus as defined in claim 11 wherein said limiting means comprises means for arresting rotational motion of said disc-like member including a plurality of annularly spaced stops positioned at preselected arcs of rotation about the periphery of said disc-like member.

15. Apparatus as defined in claim 14 wherein said limiting means further comprises means carried by said planar member for disengaging said arresting means responsive to a predetermined rotation of said planar member relative to said disc-like member.

16. Apparatus as defined in claim 15 wherein said arresting means comprises:

(a) first and second stops formed in the periphery of said disc-like member having a predetermined angular separation;

(b) first and second latch members biased for and positioned for simultaneous engagement of said stop members to arrest rotation of said disc-like member in either direction; and (c) secondary latch members biased toward engagement in one of said stops upon rotational displacement of said disc-like members through a predetermined incremental arc.

17. An apparatus for the operation and control of a multi-position switch comprising:

(a) an operation disc connected to said multi-position switch and rotatable concomitantly therewith about an axis normal to said disc;

(b) means for arresting rotational motion of said disc at a selected angular position;

(c) a loading disc mounted parallel to said operating disc and rotatable about said axis;

(d) a spring assembly providing the exclusive connection between said loading disc and said operating disc such that said spring assembly stores energy when said loading disc is rotated relative to said operating disc; and (e) means for disengaging said arresting means responsive to the rotational motion of said loading disc through a predetermined arc such that said operating disc is rotated through a related arc by said spring assembly.

18. Apparatus as defined in claim 17 wherein said arresting means comprises:

(a) first and second stops formed in the periphery of said disc-like member having a predetermined angular separation;

(b) first and second latch members biased for and positioned for simultaneous engagement of said stop members to arrest rotational motion of said disc-like member in either direction; and (c) secondary latch members biased toward engagement in one of said stops upon rotational displacement of said disc-like members through a predetermined incremental arc.

19. Apparatus as defined in claim 18 wherein said disengaging means comprises spaced apart cam members carried by said planar member for engagement with said latch means to urge said latch means out of engagement with said recesses.

20. Apparatus as defined in claim 17 wherein said spring assembly comprises a pair of parallel spring members mounted with each having one end connected to said planar member and another end connected to said disc-like member such that one spring is compressed and the other is elongated by relative motion of said planar member and said disc-like member about said axis.

* * * * *